United States Patent [19]

Morikawa et al.

[11] Patent Number: 4,548,128

[45] Date of Patent: Oct. 22, 1985

[54] FUME HOOD

[75] Inventors: Tatsumi Morikawa, Tokyo; Yoshio Osawa, Kasukabe; Takao Kawakami, Kitamoto; Naoki Yoshida, Sagamihara, all of Japan

[73] Assignee: Yamato Scientific Co., Ltd., Japan

[21] Appl. No.: 566,435

[22] Filed: Dec. 28, 1983

[30] Foreign Application Priority Data

Sep. 29, 1983 [JP] Japan ..... 58-179214

[51] Int. Cl.[4] ..... F23J 11/00

[52] U.S. Cl. ..... 98/115.3; 98/115.1

[58] Field of Search ..... 98/115 LH, 115 R; 73/202

[56] References Cited

U.S. PATENT DOCUMENTS

| | | | |
|---|---|---|---|
| 2,624,199 | 1/1953 | Boyer | 73/202 |
| 3,811,250 | 5/1974 | Fowler, Jr. | 98/115 LH |
| 4,377,969 | 3/1983 | Nelson | 98/115 LH |

OTHER PUBLICATIONS

WO 82-04120, International Publication (PCT) Rutherford.

*Primary Examiner*—Henry C. Yuen
*Assistant Examiner*—John Kwon
*Attorney, Agent, or Firm*—Wigman & Cohen

[57] ABSTRACT

A fume hood forming an experimental work space includes a sensor for detecting an air speed within the exhaust duct. The sensor is provided in a by-pass section which is positioned on the exhaust duct and in communication with the ambient air.

3 Claims, 4 Drawing Figures

FUME HOOD

BACKGROUND OF THE INVENTION

The present invention relates to a fume hood having an apparatus for measuring the quantity of air flow.

An object of a fume hood is to protect an experimenter from noxious fumes generated during experiment. Its important function is to exhaust noxious fumes generated within the fume hood.

In general, the exhaust capability of a fume hood is represented by the inlet velocity of ambient air flowing through an opening in the front face. That is to say, the quantity of air flow exhausted can be generalized as follows:

Quantity of air flow exhausted in one minute ($m^3$/minute)=Area of opening in the front face ($m^2$)×inlet air flow velocity (m/second)×60.

The inlet air flow velocity depends upon the conditions of an experiment carried out in the fume hood including kinds and amounts of gases generated during the experiment.

For assuring the safety of a fume hood, therefore, it is necessary to confirm the operation condition of the fume hood, i.e., whether the inlet air velocity on the front face is suitable or not. Confirmation of this operation condition can be conducted by measuring a quantity of air flow discharged from the exhaust duct of the fume hood.

For the purpose of measuring the quantity of the discharged airflow, it is conceivable to install an air flow velocity sensor such as a hot-wire anemometer in the exhaust duct and to convert the flow rate of air discharged from the exhaust dust into an air velocity value for direct measurement.

In many cases, however, gases generated in the fume hood are extremely corrosive. Sometimes, mist is generated in addition to gases. Therefore, an air flow velocity sensor installed directly in the exhaust duct could not put up with a long-time use since the measuring part is attacked by a corrosive gas. In addition, mist sticked to the measuring part would cause mulfunction to obstruct precise measurement.

SUMMARY OF THE INVENTION

An object of the present invention is to provide a fume hood having a measurement portion comprising a air flow velocity sensor which can put up with a long-time continuous use because the measuring part of the air flow velocity sensor is not exposed to a corrosive gas or mist generated within the fume hood.

In order to accomplish this object, there is provided in accordance with the present invention a fume hood for exhausting gases generated within a fume hood 1 through an exhaust duct 3 by an exhaust blower, comprising: a by-pass section 5 which is provided at the suction side of said exhaust blower on said exhaust duct 3 and which is in communication with the ambient air; and an air-flow velocity sensor 7 which is provided within said by-pass section 5 for detecting the by-pass air flow velocity Vs of the ambient air drawn into said exhaust duct 3 through said by-pass section, the exhaust airflow rate Q of the exhaust duct 3 being determined from the value detected by said air flow velocity sensor 7.

DETAILED DESCRIPTION OF PREFERRED EMBODIMENT

Figure 1:
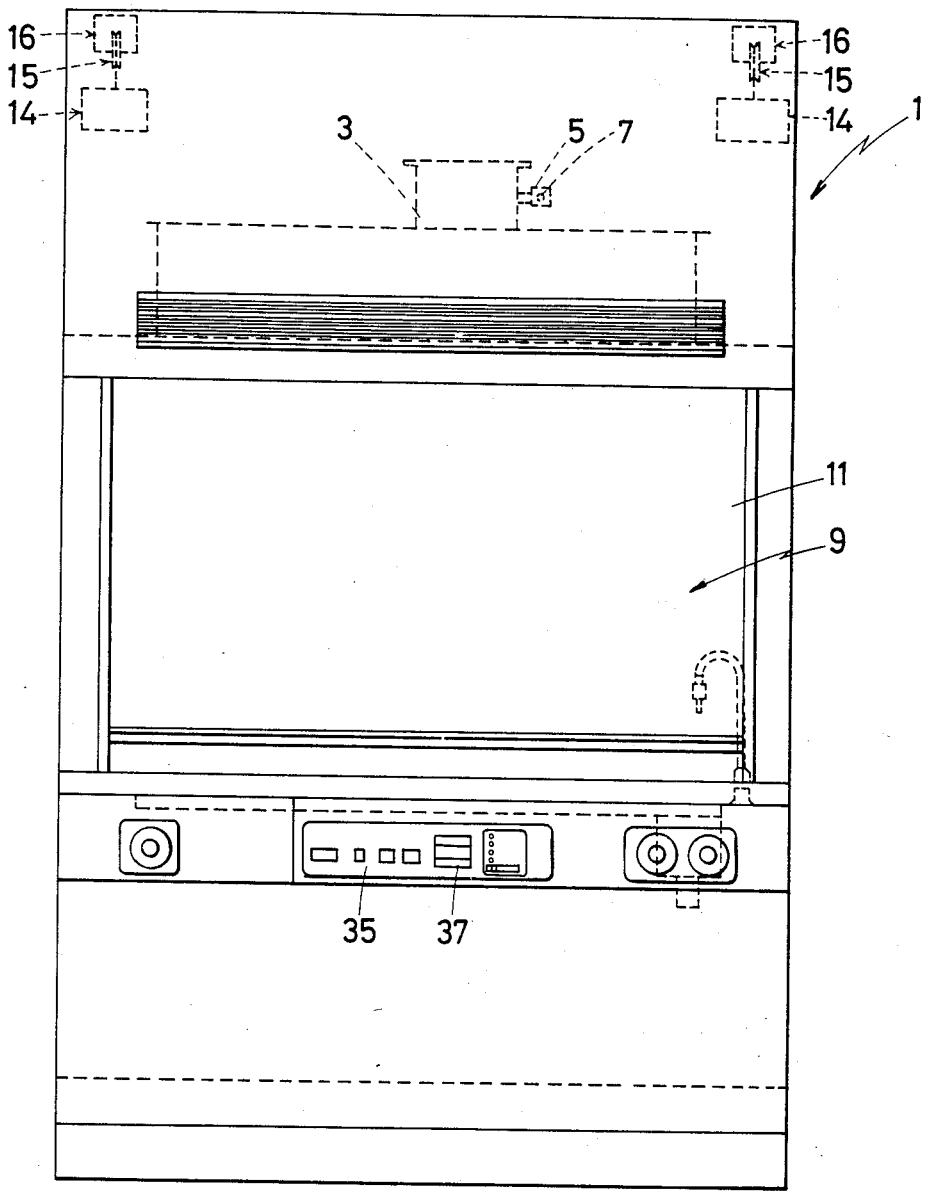
FIG. 1 is a front elevational view of one embodiment of the fume hood according to the present invention.
Figure 2:
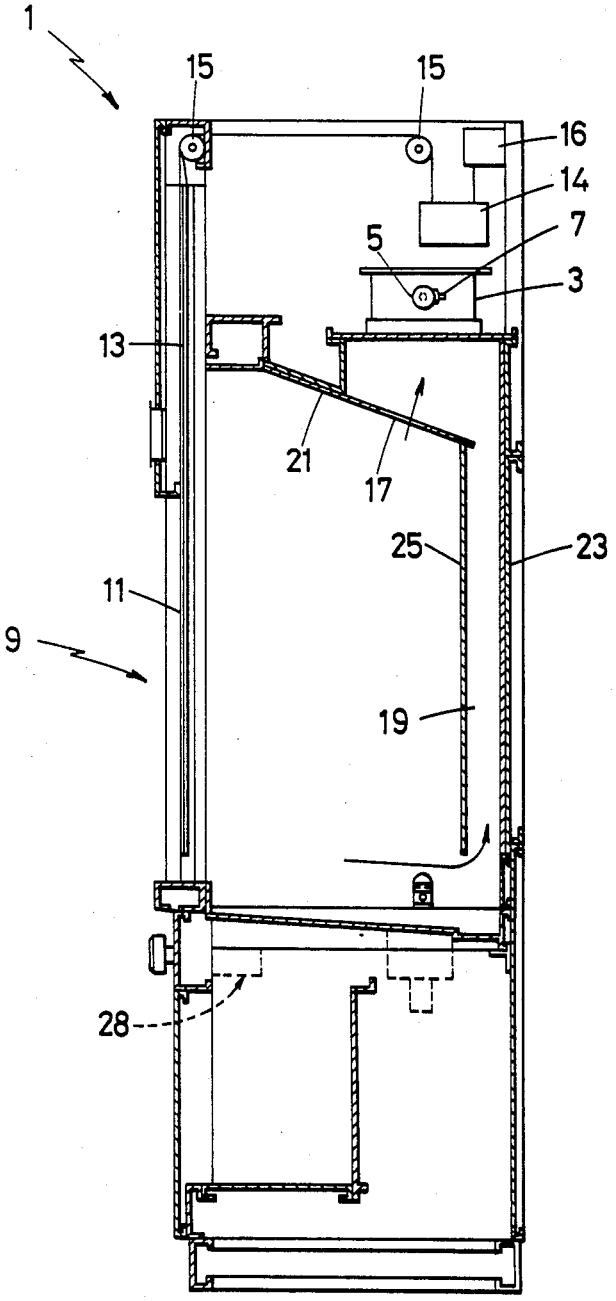
FIG. 2 is a lateral sectional view of the embodiment of FIG. 1.

FIG. 1 and FIG. 2 are respectively a front view and a lateral sectional view of a fume hood 1. A glass door 11 is provided on a front opening 9 and an exhaust duct 3 is provided on the upper part of the fume hood 1. The glass door 11 is supported by wire 13 at its upper left and right portions. The glass door 11 may be arbitrarily moved upward or downward by winding up or down the wire 13 via pulleyes 15. And the opening area within the front opening section 9 may be adjusted by moving the glass door 11 upward or downward. The wire 13 is wound around a worm (not illustrated) in a front glass opening detector 16 via a weight 14, wherein the detector 16 detects the opening degree of the glass door based upon the rotation direction and rotation amount of the worm.

Provided within the fume hood 1 are an exhaust aperture 17 which is in communication with the above-described exhaust duct 3 and a by-pass air flow path 19. The exhaust aperture 17 is provided on an upper wall 21. The by-pass air path 19 is defined by a rear wall 23 of the fume hood 1 and a buffleplate 25 depending from the rear end of the upper wall 21.

Provided on the exhaust duct 3 are a blower (not illustrated) and a by-pass section 5 which is positioned on the suction side of the exhaust blower at a right angle in relation to the side wall of the exhaust duct 3 and in communication with the ambient air.

Figure 3:
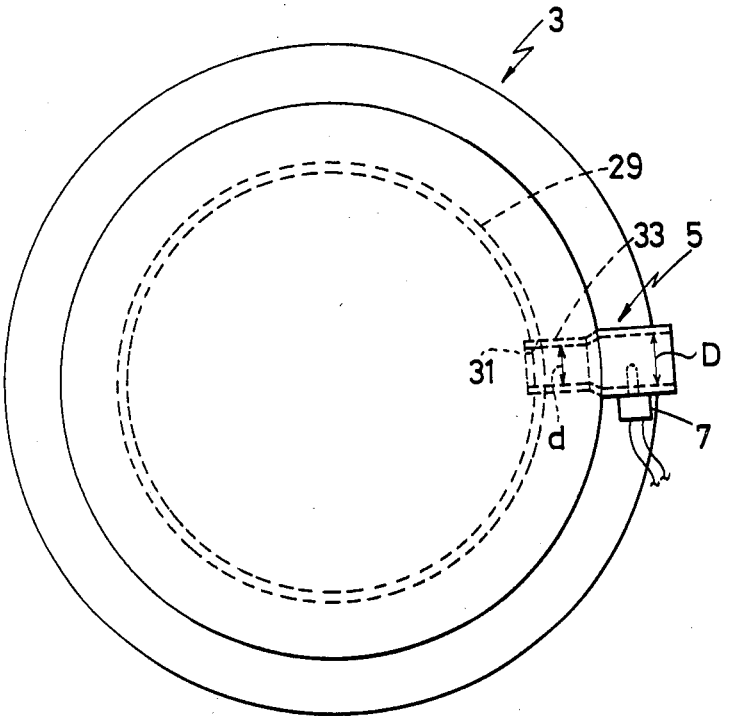
FIG. 3 is top view of the exhaust duct 3 shown in FIG. 1.
Figure 4:
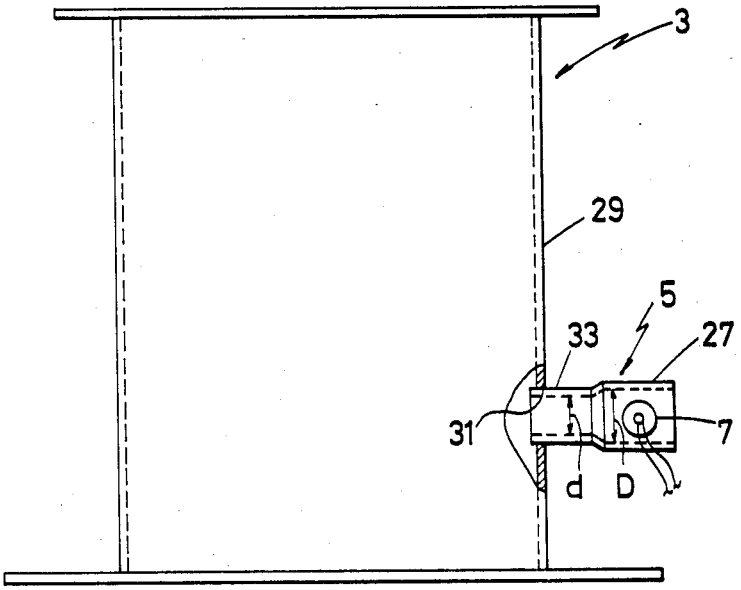
FIG. 4 is a side view of the exhaust duct 3 shown in FIG. 1.

As shown in FIG. 3 and FIG. 4, the by-pass section 5 is composed of a suction section 27 for drawing the ambient air and an fitting section 33 to be inserted to a through hole 31 which is provided on a cylindrical wall 29 of the exhaust duct 3. The diameter D of the suction section 27 is made to be larger than the diameter d of the fitting section 33 so that the velocity of the ambient air drawn by the suction section 27 may be decreased.

Provided in the suction section 27 of the by-pass section 5 is an air flow velocity sensor 7 such as a hot-wire anemometer for detecting the by-pass air flow velocity Vs of the ambient air which has been drawn by the suction section 27. The by-pass air flow velocity Vs of the by-pass section 5 thus detected by the air flow velocity sensor 7 becomes large as the air flow velocity in the exhaust duct is increased. The correlation between them yields the air flow velocity in the exhaust duct, which in turn provides the discharged airflow, In this case, with the by-pass secton being tailored removable, it is possible to select an arbitrary diameter of the suction section in the by-pass section, whereby it is possible to establish the optimum measurement range of the air flow velocity sensor in correspondence with the wide-range measurement of an exhaust airflow rate.

By using this fume hood, not only the exhaust of air contained in the fume hood but also the ventilation of air contained in the room housing that fume hood become possible. At this time, it is important for the health of a person working in the room to know the ventilation effectiveness in that room. An arithmetic unit 28 computes the airflow exhausted from the exhaust duct 3 and the inlet air flow velocity of the ambient air flowing through the opening of the glass door using the opening degree of the glass door which has been detected by the glass opening detector 16. U.S. Pat. No. 3,811,250 issued May 21, 1974, discloses a known arithmetic unit which could be used as arithmetic unit 28. The exhaust airflow and the inlet air flow velocity thus computed are displayed on a digital display 37 provided on a control panel 35.

The operation will now be described.

Gases generated within the fume hood 1 are exhausted from the exhaust duct 3 through the exhaust aperture 17 and the by-pass air path 19 by the ambient air flowing into the hood through the front opening 9 with an appropriate inlet air flow velocity. At this time, gases having small specific gravities flow into the exhaust duct 3 through the exhaust aperture 17, and gases having large specific gravities flow into the exhaust duct 3 through the by-pass air path 19.

By the exhaust air from the exhaust duct 3, the ambient air is drawn into the exhaust duct 3 from the by-pass section 5.

The by-pass air flow velocity Vs of the ambient air when drawn into this by-pass section 5 is detected by the air flow velocity sensor 7. The arithmetic unit also has a function of computing the degree of ventilation in the room wherein the fume hood is placed. That is to say, when the volume of the installation room (or symbols each representing a rank whereto the volume belongs) is inputed through the control panel, the arithmetic unit 28 outputs the degree of ventilation based upon the volume of the installation room and the exhaust airflow, the degree of ventilation being displayed on the digital display 37. In this case, the degree of ventilation is represented by the number of ventilation works, i.e., the number of replacements of the air within the installation room per hour whereto the amount of ventilation corresponds.

What is claimed is:

1. A fume hood comprising:

a hood forming an experimental work space, an exhaust duct for exhausting the air in the workspace, a by-pass section provided on said exhaust duct, said by-pass section being in communication with the ambient air, said by-pass section having a small diameter portion fitted at a right angle to said exhaust duct and a large diameter portion fitted to said small portion, and an air velocity sensor provided in said large portion of said by-pass section, whereby the ratio of said small diameter portion of said by-pass section to said large diameter portion of said by-pass section is such that the velocity of the air in said large diameter portion is suitable to detect the variation of the velocity of the air in said hood.

2. A fume hood claimed in claim 1, wherein, said velocity sensor is a hot-wire anemometer.

3. A fume hood claimed in claim 2, wherein, said by-pass section is composed of a fitting section connected to said exhaust duct and a suction section which diameter is larger than the diameter of said fitting section, and said sensor is provided on said suction section.

* * * * *